US010463203B2

(12) United States Patent
Hozumi

(10) Patent No.: US 10,463,203 B2
(45) Date of Patent: Nov. 5, 2019

(54) TOWEL PRODUCT AND MANUFACTURING METHOD FOR TOWEL PRODUCT

(71) Applicant: UCHINO CO., LTD., Chuo-ku (JP)

(72) Inventor: Shuichi Hozumi, Chuo-ku (JP)

(73) Assignee: UCHINO CO., LTD., Chuo-ku (JP)

( * ) Notice: Subject to any disclaimer, the term of this patent is extended or adjusted under 35 U.S.C. 154(b) by 0 days.

(21) Appl. No.: 14/442,521

(22) PCT Filed: Mar. 31, 2014

(86) PCT No.: PCT/JP2014/059561
§ 371 (c)(1),
(2) Date: May 13, 2015

(87) PCT Pub. No.: WO2014/129675
PCT Pub. Date: Aug. 28, 2014

(65) Prior Publication Data

US 2016/0037977 A1 Feb. 11, 2016

(30) Foreign Application Priority Data

Feb. 22, 2013 (JP) ..... 2013-033744

(51) Int. Cl.
*A47K 10/02* (2006.01)
*D03D 27/02* (2006.01)
(Continued)

(52) U.S. Cl.
CPC ..... *A47K 10/02* (2013.01); *D03D 1/0017* (2013.01); *D03D 13/004* (2013.01);
(Continued)

(58) Field of Classification Search
CPC ..... A47K 10/02; D03D 27/06; D03D 27/08; D03D 1/0017; D03D 13/004; D03D 13/008; D10B 2503/00; Y10T 428/23957
(Continued)

(56) References Cited

U.S. PATENT DOCUMENTS 2,012,719 A * 8/1935 Holt ..... D03D 27/08
139/391
2,371,199 A * 3/1945 Walliser ..... D03D 27/06
139/402
(Continued)

FOREIGN PATENT DOCUMENTS

CN 201924135 U * 8/2011
CN 106436123 A * 2/2017
(Continued)

OTHER PUBLICATIONS

"Terry Weaving," Oct. 25, 2011, htpps://textInfo.file.wordpress.com/2011/10/terry-towel.pdf.*
(Continued)

*Primary Examiner* — Cheryl Juska
(74) *Attorney, Agent, or Firm* — Oblon, McClelland, Maier & Neustadt, L.L.P.

(57) ABSTRACT

Provided is a towel product that ensures equivalent performance as the prior art in terms of water absorbency property and the like, while improving pile retention property. A towel is formed from a warp, a weft and a pile. The warp comprises sets of warp yarns. The pile comprises pile yarns that form the upper and the lower. The warp density is 27-33 threads/inch, and the weft density is 49-58 threads/inch. The pile ratio is 3.8-6.2. The configuration of 1 repeat is composed of 5 picks, and the configurations of 1 repeat are repeated. The 3 picks corresponding to weft yarns W2-W4 and thereof. W7-W9 compose the pile forming section. The 2 picks corresponding to weft yarns W5 and W6 compose the ground woven fabric section. The pile formed in the pile forming section has 3-6 snarls, preferably 4-5, and in the diagram, 4.

8 Claims, 22 Drawing Sheets

(51) Int. Cl.

| | |
|---|---|
| ***D03D 1/00*** | (2006.01) |
| ***D03D 27/06*** | (2006.01) |
| ***D03D 13/00*** | (2006.01) |
| ***D03D 27/08*** | (2006.01) |

(52) U.S. Cl.
CPC ..... *D03D 13/008* (2013.01); *D03D 27/02* (2013.01); *D03D 27/06* (2013.01); *D03D 27/08* (2013.01); *D10B 2503/00* (2013.01); *Y10T 428/23957* (2015.04)

(58) Field of Classification Search
USPC ..... 428/92; 139/2, 391, 396; 28/162, 167; 26/27, 29 R
See application file for complete search history.

(56) References Cited

U.S. PATENT DOCUMENTS

| | | | | | |
|---|---|---|---|---|---|
| 2,379,085 | A * | 6/1945 | Kahn | D05C 17/02 | 112/411 |
| 2,486,942 | A * | 11/1949 | Groat | D03D 27/12 | 139/403 |
| 2,655,950 | A | 10/1953 | Mills | | |
| 2,718,243 | A * | 9/1955 | Matthews | D03D 27/12 | 139/401 |
| 2,796,654 | A * | 6/1957 | Ashcroft | D05C 17/026 | 112/410 |
| 3,721,272 | A | 3/1973 | Hager | | |
| 4,825,499 | A * | 5/1989 | Baptiste | A47K 7/02 | 139/396 |
| 5,447,182 | A * | 9/1995 | Gehrig | D03D 39/22 | 139/25 |
| 6,468,621 | B1 * | 10/2002 | Landau | A47G 27/0225 | 112/410 |
| 6,668,435 | B2 * | 12/2003 | Wood | A47L 13/16 | 26/2 R |
| 7,055,227 | B2 * | 6/2006 | Love | D06C 27/00 | 26/28 |
| 7,762,286 | B1 * | 7/2010 | Speaks | D03D 27/08 | 139/21 |
| 2002/0124365 | A1 * | 9/2002 | Wood | A47L 13/16 | 26/2 R |
| 2004/0045143 | A1 * | 3/2004 | Rock | A41D 3/005 | 28/159 |
| 2006/0005335 | A1 * | 1/2006 | Ortega | A47K 10/02 | 15/118 |
| 2009/0025818 | A1 * | 1/2009 | Hozumi | D03D 1/0017 | 139/392 |
| 2009/0193592 | A1 * | 8/2009 | Stefanich | C11D 3/0068 | 8/137 |
| 2011/0052860 | A1 * | 3/2011 | Rock | A41D 3/005 | 428/91 |

FOREIGN PATENT DOCUMENTS

| | | | | |
|---|---|---|---|---|
| DE | 564949 | C | 11/1932 | |
| DE | 2540376 | A1 * | 3/1977 | D03D 27/08 |
| EP | 1 992 725 | A1 | 11/2008 | |
| GB | 408728 | A * | 4/1934 | D03D 27/08 |
| JP | 54 096176 | | 7/1979 | |
| JP | 54 101973 | | 8/1979 | |
| JP | 05 247834 | | 9/1993 | |
| JP | 2008 261076 | | 10/2008 | |
| JP | 3152796 | | 8/2009 | |
| JP | 2016023384 | A * | 2/2016 | |

OTHER PUBLICATIONS

Partial translation of DE 2540376 A1, Aug. 4, 2017.*
JPO translation of JP 3152796 U, Aug. 13, 2009.*
International Search Report dated Jun. 17, 2014, in PCT/JP14/059561 filed Mar. 31, 2014.
Extended European Search Report dated Dec. 14, 2016 in Patent Application No. 14754814.3.

* cited by examiner

DESIGN DIAGRAM

TOWEL PRODUCT AND MANUFACTURING METHOD FOR TOWEL PRODUCT

TECHNICAL FIELD

The present invention relates to a towel product that is excellent in various performances (properties) such as water absorbency property (wiping-off property of water), drying property (fast drying speed), lightness property, touch feeling (texture), and the like, and particularly excellent in pile retention property (durability), compared with conventional and general products having the same bulkiness (volume feeling) and a manufacturing method for the towel product.

BACKGROUND ART

A towel product has been widely used nowadays. A terry cloth (towel cloth) is employed, for example, in such a wide-range field of a towel, a bath towel, a gown such as a towel-made robe, and in addition hereto, a sheet.

Properties (performances) required for a towel include water absorbency property, drying property, lightness property, and touch feeling, and the like For example, a towel is frequently used to wipe a wet body after bathing. So water absorbency property is essential. Water absorbency property means that moisture that adhered to the wet body can be efficiently wiped off.

For example, in the case of drying it indoor after washing, long dry time makes bacteria propagate. It causes the occurrence of uncomfortable odor. In the case of drying it by using a drying machine, long dry time causes waste of energy.

A towel is used everyday and by anyone from children to aged persons. Heavy towel imposes burdens for children and aged persons. Thus, it is preferable to improve lightness property.

A towel is adhered directly to human skin. Touch feeling affects use feeling. Rough and hard touch feeling makes use feeling bad. Particularly soft touch feeling is preferable for persons having the sensitive skin.

Conventionally, it had been difficult to implement the towel which satisfies with above performances in proper balance. Therefore, the applicant of the present application has proposed a new towel product that is excellent in various performances such as water absorbency property, drying property, lightness property, touch feeling, and the like. (See patent document 1).

Conventional and general product (towel) has 3 picks structure (Described later). In contrast, the towel in patent document 1 has 5 to 7 picks structure. This enables drying property and lightness property. The pile of towel in patent document 1 is longer than the pile of conventional and general towel. This enables water absorbency property and good touch feeling. In other words, the towel in patent document 1 features a balanced configuration that the longer pile compensates a loss of pile density of 5 to 7 picks structure. Further, the towel in patent document 1 maintains the same bulkiness (volume feeling) as conventional and general product.

CITATION LIST

Prior Art Documents patent document 1: utility model registration JP3152796U

SUMMARY OF THE INVENTION

Problems to be Solved by the Invention

A towel has a loop pile on the surface of ground woven fabric. The loop pile is formed by slackening a pile yarn (pile warp) and being held by a weft. This structure may cause the loop pile to be hooked, or in the case of additional strong friction, to be pulled out. Repeated use or washing may make the loop pile pulled out longer. Once the loop pile is pulled away, it cannot be restored. To cut the pulled pile is only measure in order to keep using the towel. Repeated pile cut may make toughness of towel lowered. It is impossible to completely prevent a pile yarn from loosening (drop-off) in consideration of the structure of towel.

Particularly, in the case a loop pile becomes long, a ring to be formed grows large, and a pile yarn becomes easy to be hooked at the time of use and washing. When projection or something contact with a loop pile or strong friction is added to loop pile, loosening a pile yarn may occur. Further the area that one loop pile receives the friction grows large. The large area of a loop is strongly subject to external force at the time of use and washing. This may make a pile yarn easy to loosen.

By the way, a business use towel is used frequently compared with a household use towel. Further durability is required for a business use towel. For this reason, various methods that prevent a pile yarn from loosening and enhance durability (pile retention property) are studied.

One method is to use thick yarns for a warp, a weft, and a pile. Thick yarn may cause contact area of each yarn to increase so as to increase friction resistance. This method is applied to specific use for that high durability and high water absorbency property are required, for example, a towel for guest rooms of luxury hotels. However, in this method, a towel may be very heavy and thick, touch feeling may be rough and hard, and drying time may become long. It is hard to quite say that practicability is high. Obviously this method cannot be applied to a household use towel.

Another method is to make a loop pile short and further to increase structure density so as to increase the numbers of piles. This may cause a pile yarn to hardly loosen caused by hooking or friction. This method is applied to another use that high durability and low cost are required, for example, a towel for guest rooms of business hotels or a towel used in sports facility. However, in this method, a towel may be very hard, so that it may not provide comfort. Further, a short pile may make adhesion to skin lower, so that it may have low wiping property. Shortness of pile is proportional to thinness of towel. Thin towel may have low amount of water retention, so that it may have low water absorbency property.

As mentioned above, it may be difficult for pile retention property to be compatible with various performances such as water absorbency property, drying property, lightness property, touch feeling, and the like.

This invention intends to solve above problem. The purpose of the invention is to provide towel product that is excellent in pile retention property compared with conventional art (e.g. patent document 1), while maintaining various performances such as water absorbency property, drying property, lightness property, touch feeling, and the like equivalent to conventional art (e.g. patent document 1).

This invention intends to solve above another problem. The purpose of the invention is to provide towel product that is excellent in various performances such as water absorbency property, drying property, lightness property, touch feeling, and the like compared with a conventional business use towel, while maintaining pile retention property equivalent to conventional business use towel.

Solution to Problem

As described above the applicant of the present application has proposed the towel product that is excellent in various performances such as water absorbency property, drying property, lightness property, and touch feeling, and the like. (See patent document 1). Patent document 1 discloses conventional and general product as comparative example in the FIG. 7, and several embodiments in the FIGS. 1 to 6. FIG. 1 of patent document 1 shows 5 picks structure (5 picks among 5 picks form a pile forming section). FIG. 2 shows another 5 picks structure (3 picks among 5 picks form a pile forming section). FIG. 3 shows 6 picks structure (6 picks among 6 picks form a pile forming section). FIG. 4 shows 6 picks structure (6 picks among 6 picks form a pile forming section) (using 4 pile yarns). FIG. 5 shows another 6 picks structure (4 picks among 6 picks form a pile forming section). FIG. 6 shows 7 picks structure (7 picks among 7 picks form a pile forming section).

The applicant of the present application has studied pile retention property of each embodiment (FIGS. 1 to 6 of patent document 1). As the result of study, it has become clear that dispersion of pile retention property occurs among each embodiment. That is, two embodiments that FIGS. 2 and 5 of patent document 1 show have high pile retention property compared with other embodiments. The applicant of the present application has investigated the cause of high pile retention property, and focused on the ground woven fabric section that does not form the pile (described later).

Further, the applicant has studied pile retention property in another viewpoint. The applicant has become aware that temporal change (change with time) by repeated washing makes snarl(s) formed, in the case of single yarn used for pile of conventional and general product, and focused on the relationship between snarl and pile retention property (described later).

This invention has been accomplished based on the knowledge mentioned above.

In order to solve above problem, the present invention is a towel product formed from a warp, a weft and a pile. A warp density of said towel cloth is 27 to 34 ends/inch. A weft density of said towel cloth is 45 to 60 ends/inch. A pile ratio is 3.8 to 7.0. A number of picks regarding a configuration of 1 repeat is 4 to 6. Said configuration of 1 repeat has a pile forming section and a ground woven fabric section. Said pile formed in said pile forming section has 3 to 6 snarls.

Preferably, the warp density thereof is 27 to 33 ends/inch, and the weft density thereof is 50 to 58 ends/inch. The pile ratio is 4.0 to 6.0. The pile has 3 to 6 snarls.

More preferably, the warp density thereof is 28.5 to 32 ends/inch, and the weft density thereof is 53.5 to 56.5 ends/inch. The pile ratio is 4.5 to 5.5. The pile has 4 to 5 snarls.

If the external force to pull out the pile acts, the ground woven fabric section acts as resistance. Thus, the invention can improve pile retention property.

If the external force to pull out the pile acts, snarls acts as resistance. Thus, the invention can improve pile retention property. Especially, even if one snarl becomes unable to resist, the next snarl resists. Thus, the invention can resist surely.

Formation of snarl makes the opening area of the pile become smaller compared with the loop pile without snarl. This makes the loop not easy to be hooked by projection or something. In this point, the invention can improve pile retention property.

Preferably, said pile is formed of a single yarn.

Preferably, said pile is formed of a double yarn, and said snarl is formed by adding the rotary motion with the special brush, or by kneading in water flow.

Preferably, said number of picks regarding the configuration of 1 repeat is 5, said pile forming section is formed of 3 picks, said ground woven fabric section is formed of 2 picks.

Preferably, said number of picks regarding the configuration of 1 repeat is 5, said pile forming section is formed of 4 picks, said ground woven fabric section is formed of 1 pick.

Preferably, said number of picks regarding the configuration of 1 repeat is 6, said pile forming section is formed of 4 picks, said ground woven fabric section is formed of 2 picks.

Preferably, said number of picks regarding the configuration of 1 repeat is 6, said pile forming section is formed of 3 picks, said ground woven fabric section is formed of 3 picks.

Preferably, said number of picks regarding the configuration of 1 repeat is 4, said pile forming section is formed of 3 picks, said ground woven fabric section is formed of 1 pick.

In order to solve above problem, the present invention is the manufacturing method for towel product. The method comprises a forming towel cloth step and a forming snarl step. In said forming towel cloth step, said towel cloth is formed. Said towel cloth is formed from a warp, a weft and a pile, a warp density of said towel cloth is 27 to 34 ends/inch, a weft density of said towel cloth is 45 to 60 ends/inch, a pile ratio is 3.8 to 7.0, a number of picks regarding a configuration of 1 repeat is 4 to 6, and a configurations of said picks has a pile forming section and a ground woven fabric section. In said forming snarl step, said towel cloth is processed to form 3 to 6 snarls in said pile.

Preferably, said pile is formed of a single yarn, and said processing at said forming snarl step is to knead said towel cloth in water flow.

Preferably, said pile is formed of a double yarn, and said processing at said forming snarl step is to add a rotary motion with a special brush to said towel cloth, or to knead said towel cloth in water flow.

Advantageous Effects of Invention

The invention can improve pile retention property compared with conventional art (e.g. patent document 1), while maintaining various performances such as water absorbency property, drying property, lightness property, touch feeling, and the like equivalent to conventional art (e.g. patent document 1).

The invention can improve various performances such as water absorbency property, drying property, lightness property, touch feeling, and the like compared with conventional business use towel, while maintaining pile retention property equivalent to conventional business use towel.

The towel of the invention can be applied to any use without distinctions such as a household use towel, a towel for guest rooms of luxury hotels, a towel for guest rooms of business hotels. This makes mass production possible, so that it can reduce production cost.

DESCRIPTION OF EMBODIMENTS

The 1st Embodiment

•Overview of Configuration•

Figure 1:
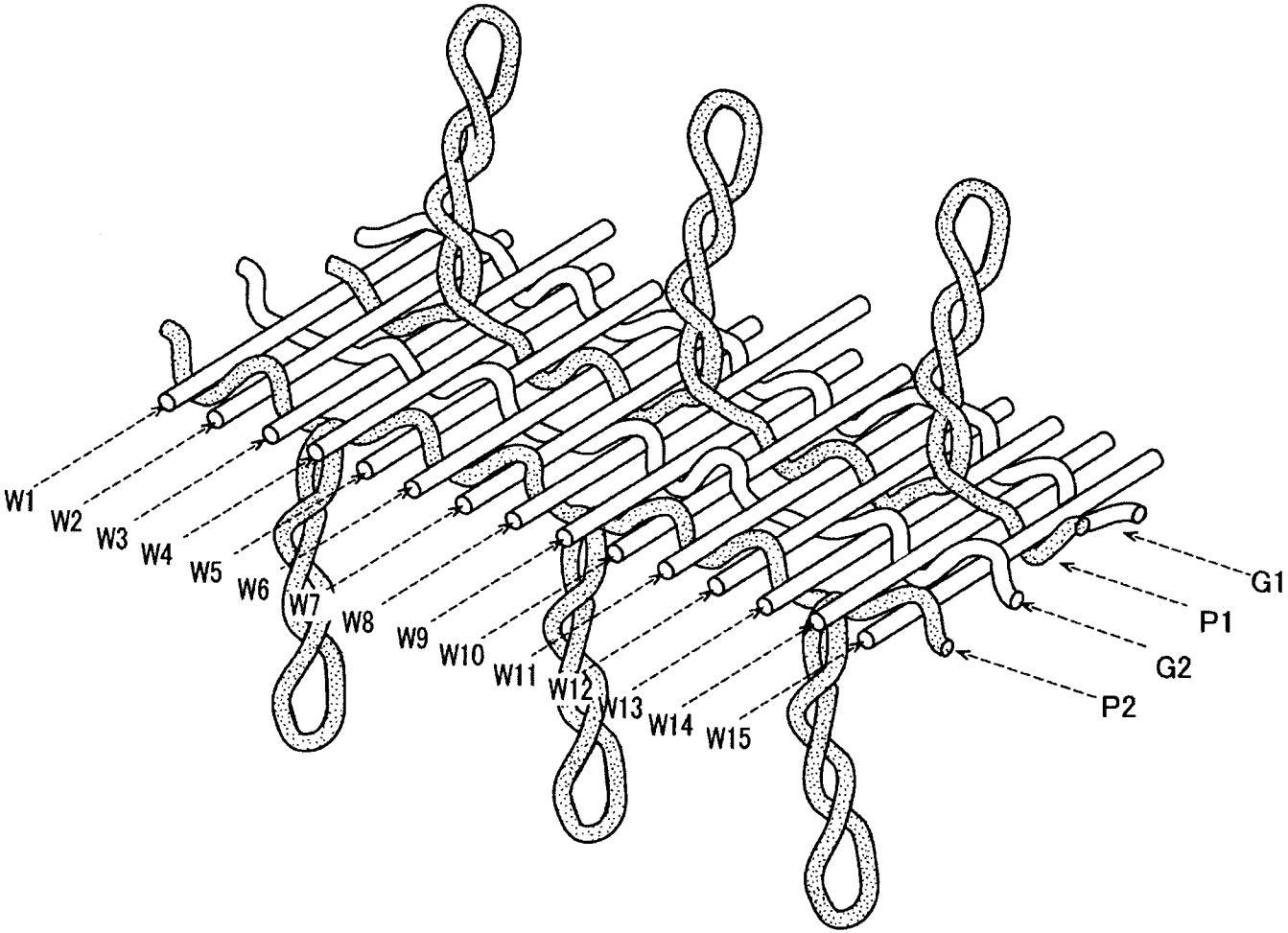
FIG. 1 is a schematic and perspective diagram of the 1st embodiment.
Figure 2A:
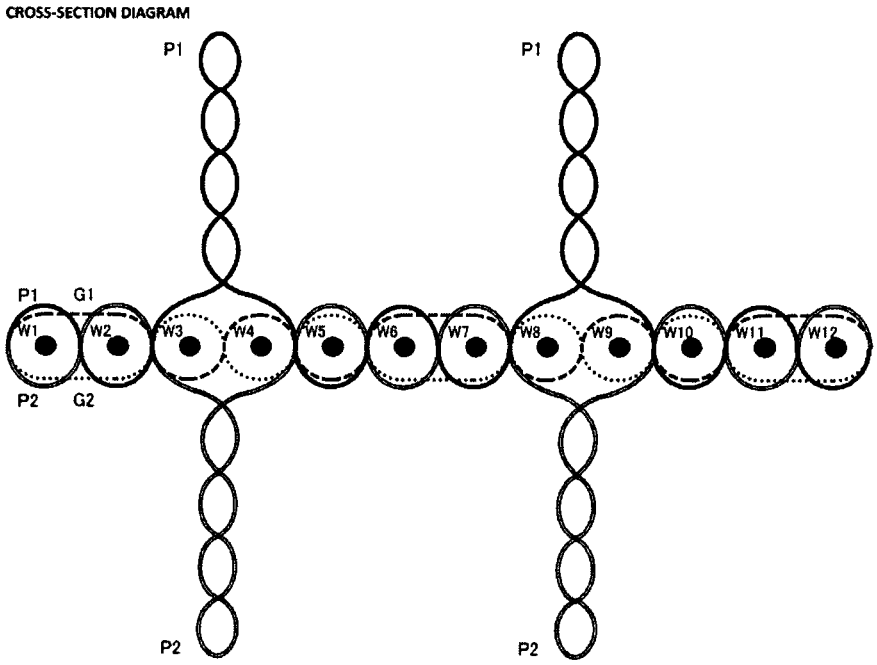
FIG. 2A is a cross-section diagram of the 1st embodiment.
Figure 2B:
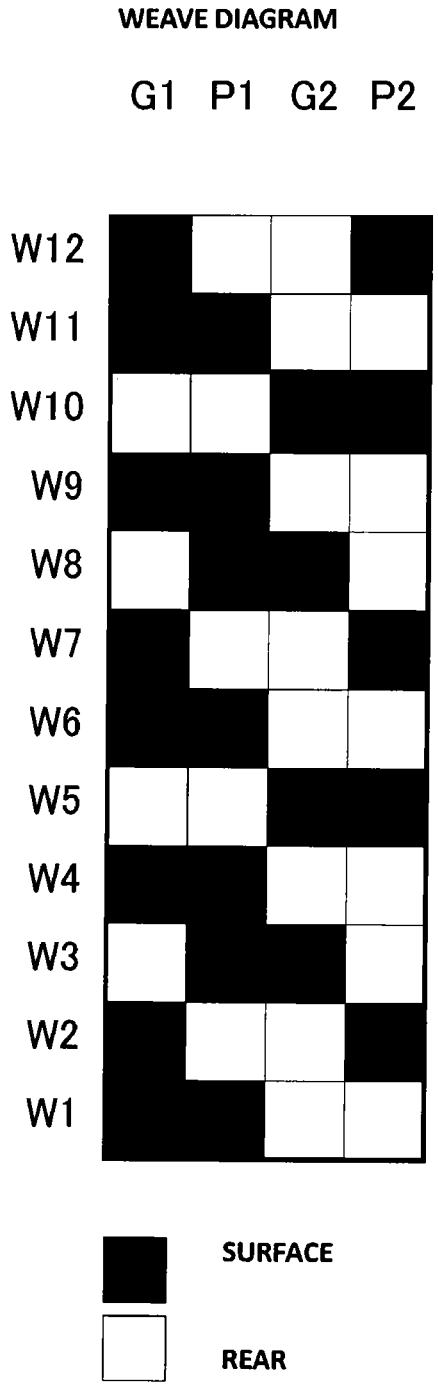
FIG. 2B is a weave diagram of the 1st embodiment.
Figure 2C:
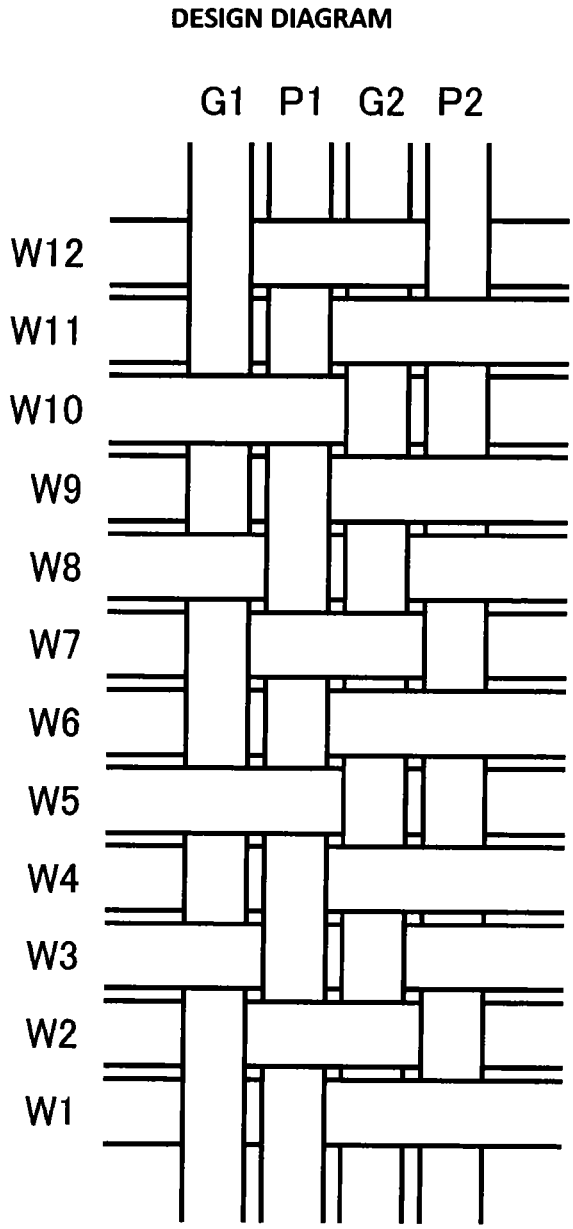
FIG. 2C is a design diagram of the 1st embodiment.

FIGS. 1 and 2 shows the towel product of the 1st embodiment of the present invention. FIG. 1 is a schematic and perspective diagram. FIG. 2A is a cross-section diagram. FIG. 2B is a weave diagram. FIG. 2C is a design diagram. A towel product is configured by using a warp, a weft, and a pile. The warp comprises sets of warp yarns (G1, G2). The warp density (number of reed, number of the warp/1 inch of length of a weft direction) thereof is 27 to 34 ends/inch, and the weft density (gear, number of the weft per 1 inch of length of a warp direction) thereof is 45 to 60 ends/inch. The pile ratio (pile scale factor, pile magnification, length of a pile yarn per length of a warp yarn) is 3.8 to 7.0.

Preferably, the warp density thereof is 27 to 33 ends/inch, and the weft density thereof is 50 to 58 ends/inch. The pile ratio is 4.0 to 6.0.

More preferably, the warp density thereof is 28.5 to 32 ends/inch, and the weft density thereof is 53.5 to 56.5 ends/inch. The pile ratio is 4.5 to 5.5.

The pile comprises pile yarns P1 (bold line in figure) that form the upper pile and pile yarns P2 (double line in figure) that form the lower pile. For convenience of the explanation, only pile yarn P1 will be described, as follows.

The number of pick is 5. That is, 1 repeat is configured with 5 picks and the configurations of 1 repeat are repeated.

The configuration of the 1 repeat (5 picks) has a pile forming section formed of 3 picks and a ground woven fabric section formed of 2 picks.

The pile yarn rises between the weft yarns W2 and W3, and returns between the weft yarns W4 and W5. In order to compare with conventional and general product, the pile forming section is defined as the 3 picks correspond to the weft yarns W2-W4, though the weft yarn W5 involves in formation of pile actually. Similarly, the 3 picks correspond to the weft yarns W7-W9 compose the pile forming section.

At the 2 picks correspond to the weft yarns W5-W6, pile yarn crosses weft yarn without forming pile. The ground woven fabric section is defined as the 2 picks. Similarly, the 2 picks correspond to the weft yarns W10-W11 is the ground woven fabric section.

The pile formed in the pile forming section has snarls. The number of snarls is 3 to 6. Preferably, the number of snarls is 4 to 5. In the diagram, the number of snarls is 4.

Here, 1 snarl is defined as a part formed by nodal point and approximately annulation (ring form), while pile yarn twists in pile.

In addition, a hollow yarn is used for a pile yarn so as to further improve water absorbency property, drying property, lightness property and the like.

•Formation of Snarl•

In some cases, a single yarn is used for a pile, and in other cases, a double yarn is used for a pile.

In the case of a single yarn, after forming towel cloth, it is submerged in water tank having water flow and kneaded in water flow. Water amount is set to 10 to 15 times of towel cloth weight. A single yarn is twisted in one direction, so that shape stability is lost by kneading in water flow and snarl is formed.

In the case of a double yarn, after forming towel cloth, the rotary motion with the special brush is added to towel cloth. A double yarn is formed by twisting two single yarns mutually in opposite direction and the twist of two single yarns are cancelled each other, so that the double yarn has shape stability. It is not easily lost by kneading in water flow. Consequently snarl is formed by adding the rotary motion with the special brush.

However, even in the case of double yarn, long time kneading makes the shape stability lost so as to form snarl.

•Demonstration Test About Pile Retention Property•

The operation of the ground woven fabric section and the operation of the snarl will be explained, while comparing the present embodiment with comparative examples 1 to 3. Pile retention property is estimated by the method JIS L 1075 B. Table 1 shows the overview of the demonstration test and the comparison results.

TABLE 1

| | overview | 1 repeat | ground woven fabric section | snarl | pile retention property | approximate average |
|---|---|---|---|---|---|---|
| comparative example 1 | conventional and general product -unused- | 3 picks | non | non | 500~1000 mN | 750 mN |
| comparative example 2 | conventional and general product -temporal change- | 3 picks | non | 2 snarls | 1000~2000 mN | 1500 mN |
| comparative example 3 | prior art patent document 1 | 5 picks | 2 picks | non | 1000~2000 mN | 1500 mN |
| the 1st embodiment | the 1st embodiment | 5 picks | 2 picks | 4 snarls | 4000 mN~ | — |

Figure 3A:
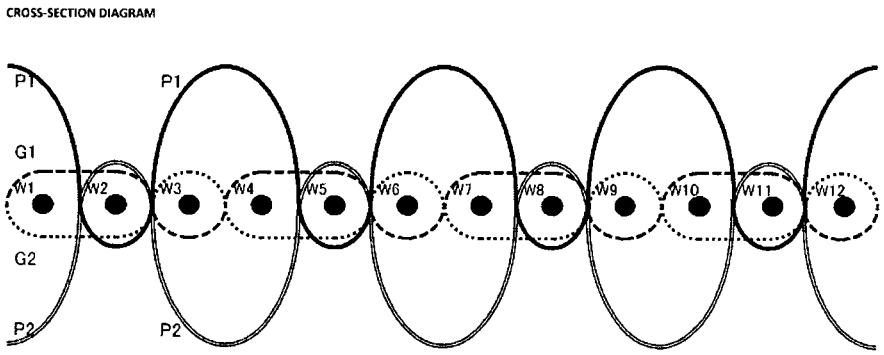
FIG. 3A is a cross-section diagram of comparative example 1.
Figure 3B:
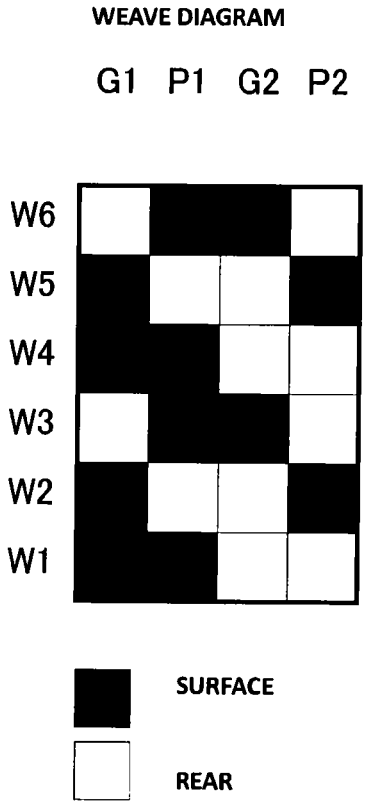
FIG. 3B is a weave diagram of comparative example 1.
Figure 3C:
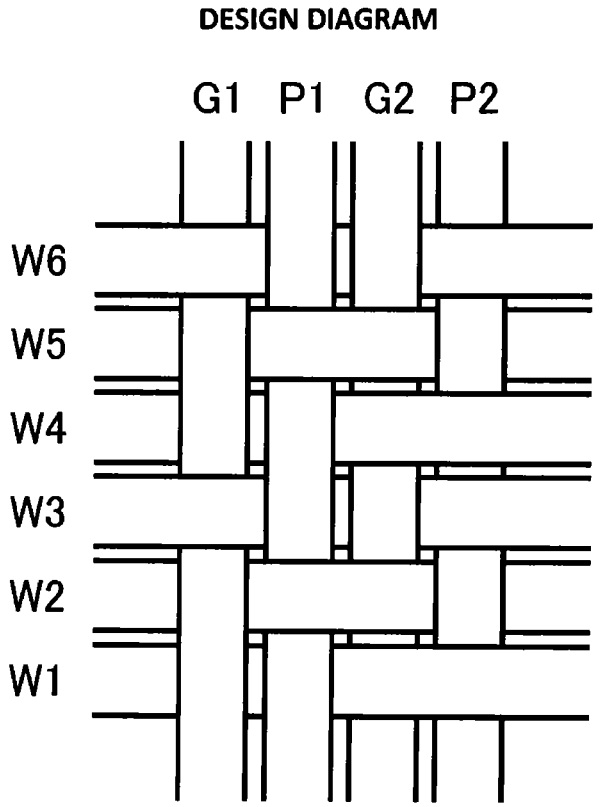
FIG. 3C is a design diagram of comparative example 1.

FIG. 3A is a cross-section diagram of comparative example 1 (conventional and general product). FIG. 3B is a weave diagram thereof. FIG. 3C is a design diagram thereof. Comparative example 1 has 3 picks structure and the pile forming section is formed of 3 picks. The pile yarn rises between the weft yarns W2 and W3, and returns between the weft yarns W4 and W5. Though the weft yarn W5 involves in formation of one pile actually, the weft yarn W5 involves also in formation of next pile. So, the pile forming section is defined as the 3 picks correspond to the weft yarns W2-W4, Similarly, the 3 picks correspond to the weft yarns W5-W7 compose next pile forming section and the 3 picks correspond to the weft yarns W8-W10 compose the pile forming section next to the next (the pile forming section correspond to W5-W7). Namely, comparative example 1 has no ground woven fabric section.

Further the pile of comparative example 1 is a loop pile and has no snarl.

Pile retention property of comparative example 1 is 500 to 1000 mN (approximate average 750 mN).

Figure 4A:
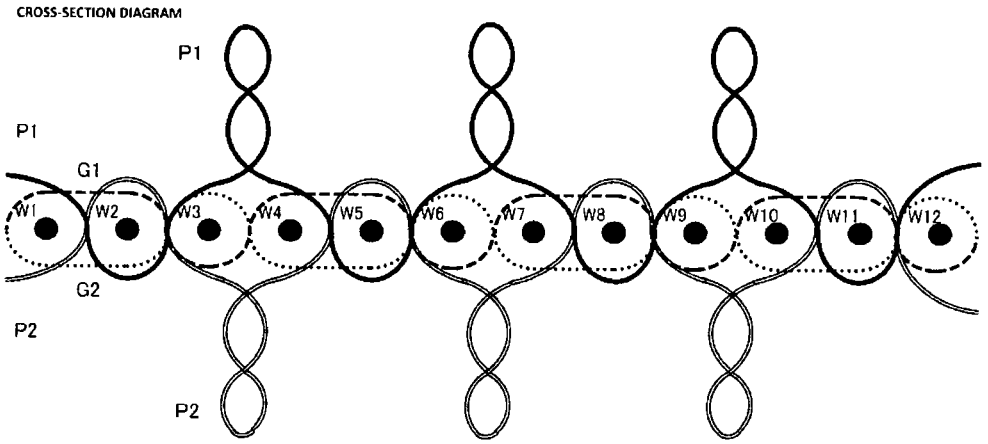
FIG. 4A is a cross-section diagram of comparative example 2.
Figure 4B:
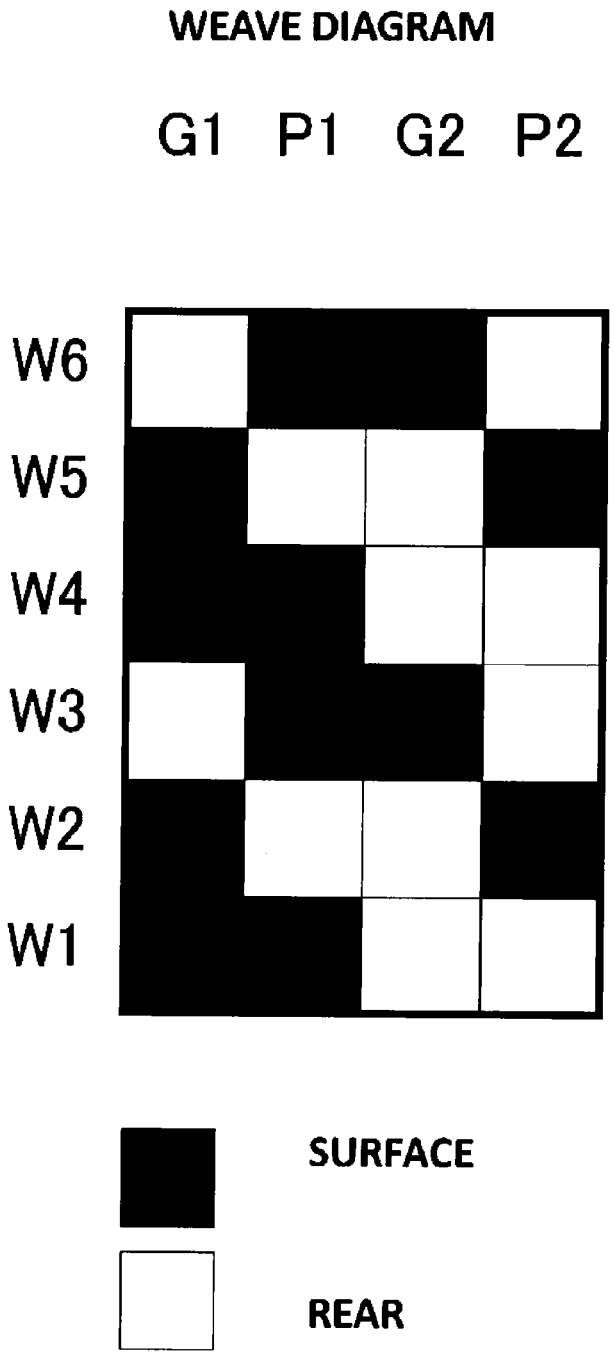
FIG. 4B is a weave diagram of comparative example 2.
Figure 4C:
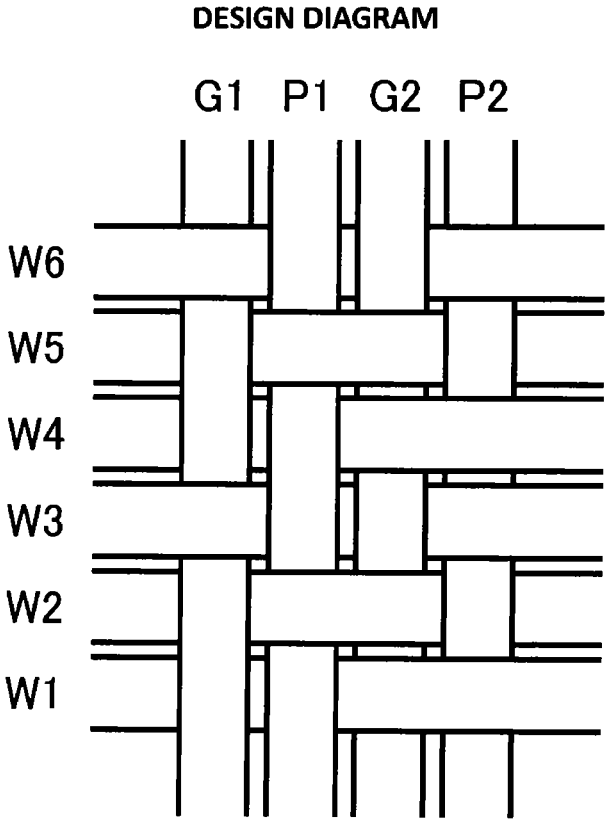
FIG. 4C is a design diagram of comparative example 2.

FIG. 4A is a cross-section diagram of comparative example 2 (conventional and general product with snarl). FIG. 4B is a weave diagram thereof. FIG. 4C is a design diagram thereof. In the case of a single yarn, temporal change by repeated washing may make snarl(s) formed. Pile length of a conventional and general product is short, so that 1 or 2 snarl(s) becomes formed. In this case, 2 snarls are added intentionally to the pile of comparative example 1 so as to form comparative example 2. Other configurations of comparative example 2 are similar to comparative example 1. Namely, comparative example 2 has no ground woven fabric section as well as comparative example 1, but it has 2 snarls in pile.

However, snarls of comparative example 2 are formed intentionally so as to become uniform, while the snarl formed area and the snarl unformed area are mixed, in the case of snarl formation by temporal change.

Pile retention property of comparative example 2 is 1000 to 2000 mN (approximate average 1500 mN). If the external force to pull out the adjacent pile acts, the formed snarl acts as resistance at the root of the piles. This may be the reason that pile retention property of comparative example 2 becomes twice as much as comparative example 1.

Figure 5A:
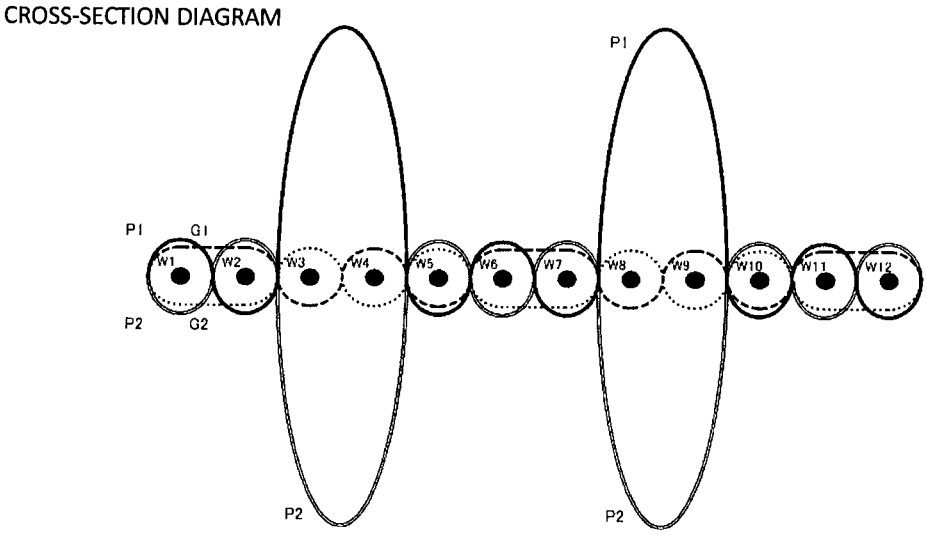
FIG. 5A is a cross-section diagram of comparative example 3.
Figure 5B:
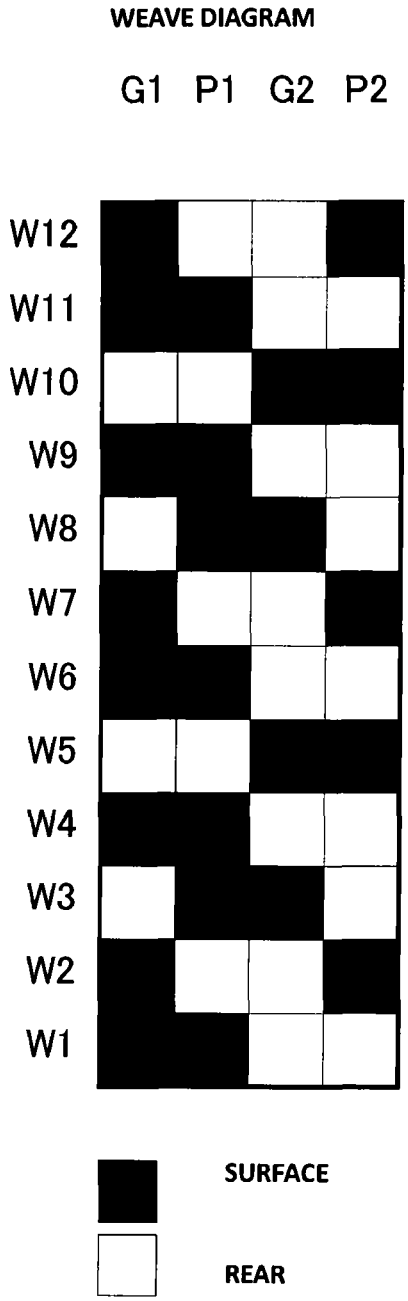
FIG. 5B is a weave diagram of comparative example 3.
Figure 5C:
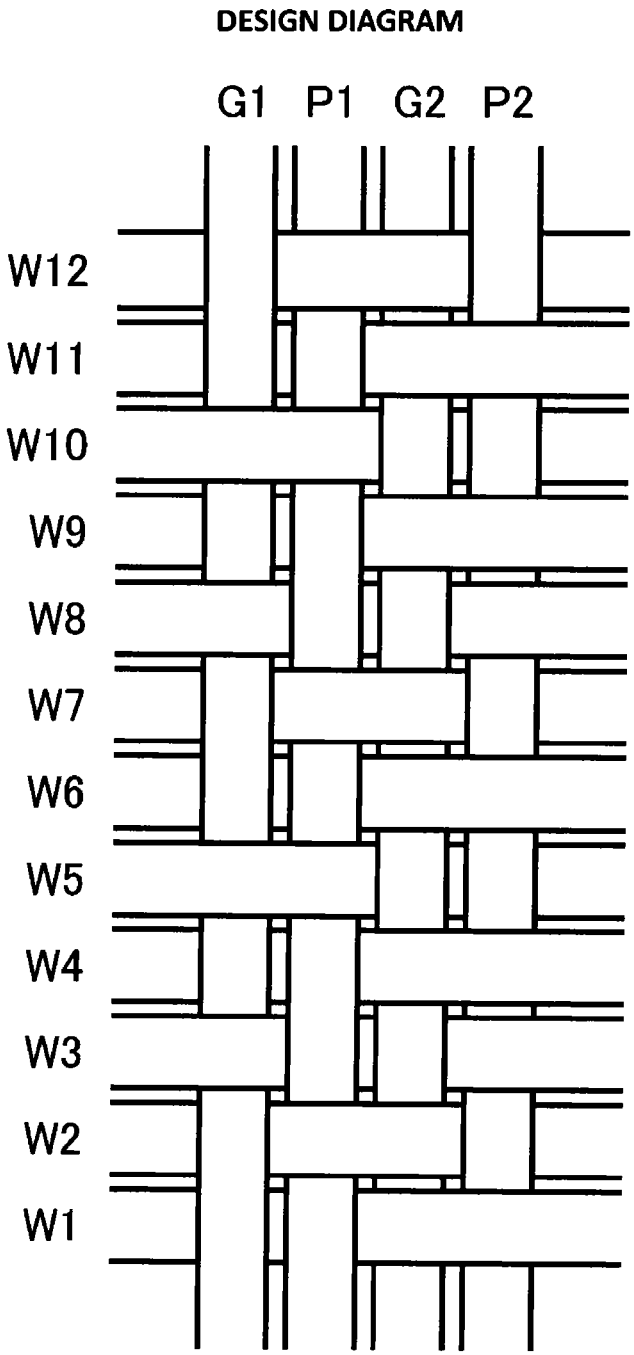
FIG. 5C is a design diagram of comparative example 3.

FIG. 5A is a cross-section diagram of comparative example 3 (conventional art, e.g. FIG. 2 of patent document 1). FIG. 5B is a weave diagram thereof. FIG. 5C is a design diagram thereof. Comparative example 3 has 5 picks structure. That is, 1 repeat is configured with 5 picks. The configuration of 1 repeat (5 picks) has the pile forming section formed of 3 picks and the ground woven fabric section formed of 2 picks (similar to the present embodiment). Namely, comparative example 3 has the ground woven fabric section as well as the present embodiment, but it has no snarl.

Pile retention property of comparative examples 3 is 1000 to 2000 mN (approximate average 1500 mN). If the external force to pull out the pile acts, the ground woven fabric section acts as resistance. This may be the reason that pile retention property of comparative examples 3 becomes twice as much as comparative example 1.

The present embodiment as shown in FIG. 2 is compared with comparative examples 1 to 3.

The present embodiment has 5 picks structure. That is, 1 repeat is configured with 5 picks. The configuration of 1 repeat (5 picks) has the pile forming section formed of 3 picks and the ground woven fabric section formed of 2 picks. Namely, the present embodiment has the ground woven fabric section. Further, it has 4 snarls.

Pile retention property of the present embodiment is stably 4000 mN and more. If the external force to pull out the pile acts, the ground woven fabric section acts as resistance. If the external force to pull out the adjacent pile acts, the formed snarl acts as resistance at root of the pile. In the case of comparative examples 2, if the stronger force to pull out the pile acts, the snarl becomes unable to resist. On the other hand, in the case of the present embodiment, even if one snarl becomes unable to resist, the next snarl resists. Thus, the present embodiment can resist surely.

The present embodiment comprises the characteristic configuration of comparative example 2 and the characteristic configuration of comparative example 3. However, the excellent pile retention property beyond the mere combination can be obtained stably.

•Effect•

As explained above, using the results of the demonstration tests, in the present embodiment, if the external force to pull out the pile acts, the excellent pile retention property can be obtained stably compared with the conventional art (comparative example 3).

Further, in the present embodiment, snarls are formed uniformly. Thus, the opening area of the pile becomes smaller compared with the conventional art (compare FIG. 2A with FIG. 5A). This makes the loop not easy to be hooked by projection or something. In this point, the pile retention property can be improved too, compared with the conventional art. Also, uniformity of snarl formation can contribute to improvement of pile retention property.

As described above, in the point of view that the snarls resist against act of the external force to pull out the pile and that the loop is hardly hooked by projection, pile retention property of the present embodiment can be improved compared with the conventional art.

Meanwhile, the present embodiment comprises the characteristic configuration of the conventional art so as to maintain various performances such as water absorbency property, drying property, lightness property, touch feeling, and the like equivalent to the conventional art. In other word, while maintaining the same bulkiness (volume feeling) as conventional and general product, adapting 5 picks structure enables drying property and lightness property and adapting longer pile enables absorbency property and good touch feeling.

Thus, the present embodiment can improve various performances such as drying property, lightness property, touch feeling, and the like, compared with a conventional business use towel such as the towel for guest rooms of luxury hotels, while maintaining pile retention property equivalent thereto.

Also, the present embodiment can improve various performances such as water absorbency property, touch feeling, and the like, compared with a conventional business use towel such as the towel for guest rooms of business hotels, while maintaining pile retention property equivalent thereto.

The present embodiment can satisfy with various performances, which are required for a towel, such as water absorbency property, drying property, lightness property, touch feeling, pile retention property (durability), and the like in proper balance to be compatible with all the performances. So the present embodiment can be applied to any use such as a household use towel, a towel for guest rooms of luxury hotels, a towel for guest rooms of business hotels without distinction of use. This makes mass production possible, so that it can reduce production cost.

•Supplementary Explanation•

The applicant of the present application has proposed the towel product that is excellent in various performances such as water absorbency property, drying property, lightness property, touch feeling, and the like. (See patent document 1). Subsequently, further, the applicant of the present application has studied pile retention property thereof. As the results of study, it has become clear that the embodiments having the ground woven fabric section have high pile retention property compared with other embodiments. In other word, the applicant of the present application has found out the action and the effect of the ground woven fabric section.

The applicant of the present application has studied pile retention property in another viewpoint and focused on the relationship between snarl and pile retention property. The applicant has become aware that temporal change by repeated washing makes snarl formed, in the case of single yarn used for pile of conventional and general product.

However, in the case of snarl formation by temporal change, snarls are sometimes formed, but are not formed at other times. Thus, it is difficult to form snarls uniformly.

Further, pile of conventional and general product (comparative example 1) is short. So the number of snarls is about 1 or 2, even if snarl is formed (See comparative example 2). If the external force to pull out the adjacent pile acts, the snarl acts as resistance at root of the pile. But, if the stronger force to pull out the pile acts, the snarl becomes unable to resist. In this manner, comparative example 2 cannot obtain pile retention property sufficiently.

In the present embodiment, the combination of the snarl and the ground woven fabric section can obtain the remarkable effect beyond the mere combination.

The 2nd to 5th Embodiment

The present invention is not limited to the above-mentioned embodiment. Various changes and modifications may be made within the scope of the invention. Other embodiments of the present invention are illustrated below.

The 2nd Embodiment

Figure 6A:
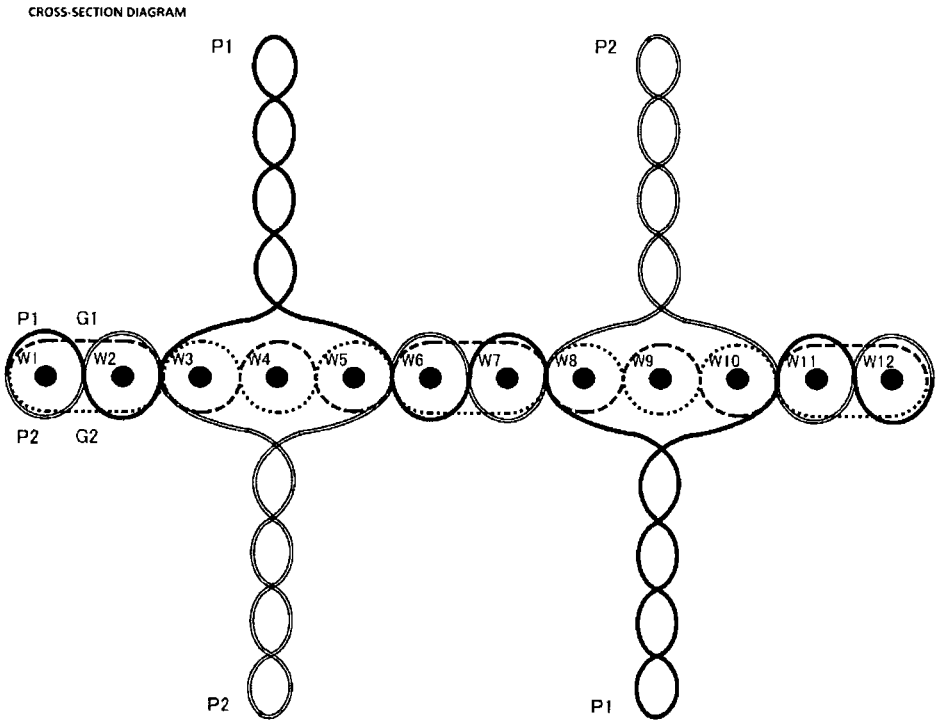
FIG. 6A is a cross-section diagram of the 2nd embodiment.
Figure 6B:
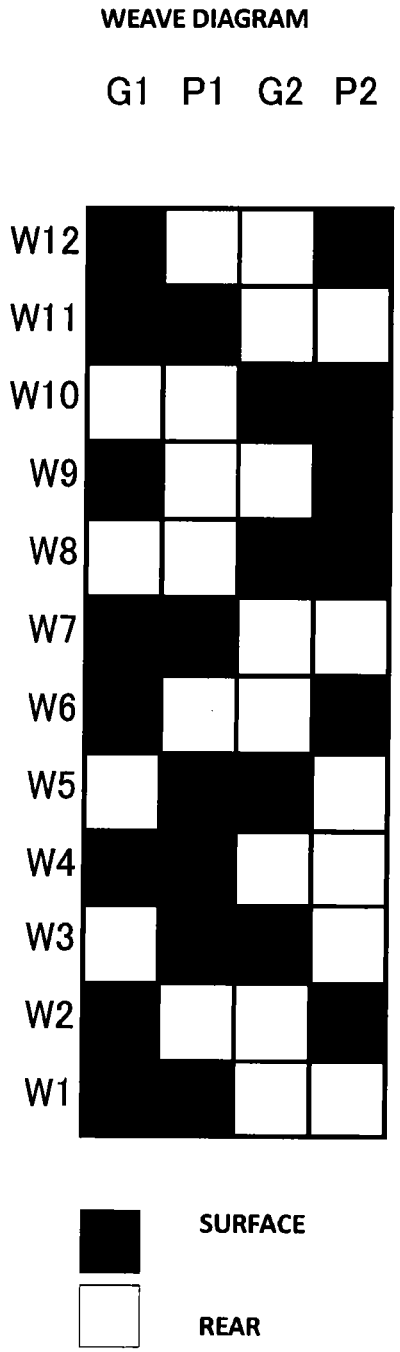
FIG. 6B is a weave diagram of the 2nd embodiment.
Figure 6C:
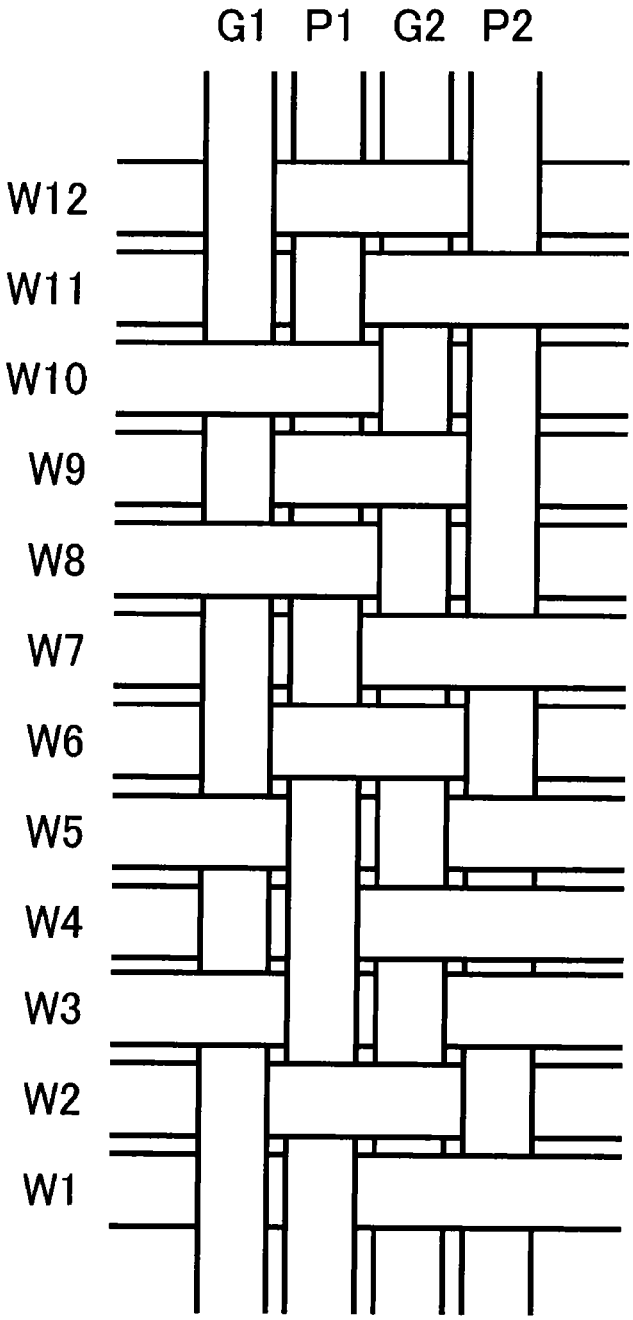
FIG. 6C is a design diagram of the 2nd embodiment.

FIG. 6 shows the towel product of the 2nd embodiment of the present invention. FIG. 6A is a cross-section diagram. FIG. 6B is a weave diagram. FIG. 6C is a design diagram. The warp density thereof is 27 to 34 ends/inch, and the weft density thereof is 45 to 60 ends/inch. The pile ratio is 3.8 to 7.0.

Preferably, the warp density thereof is 27 to 33 ends/inch, and the weft density thereof is 50 to 58 ends/inch. The pile ratio is 4.0 to 6.0.

More preferably, the warp density thereof is 28.5 to 32 ends/inch, and the weft density thereof is 53.5 to 56.5 ends/inch. The pile ratio is 4.5 to 5.5.

The number of picks is 5. That is, 1 repeat is configured with 5 picks and the configurations of 1 repeat are repeated.

The configuration of the 1 repeat (5 picks) has the pile forming section formed of 4 picks and the ground woven fabric section formed of 1 pick.

The pile yarn rises between the weft yarns W2 and W3, and returns between the weft yarns W5 and W6. The pile forming section is composed of the 4 picks correspond to the weft yarns W2-W5. Similarly, the 4 picks correspond to the weft yarns W7-W10 compose the pile forming section.

At the 1 pick correspond to the weft yarn W1 or W6 or W11, pile yarn crosses weft yarn without forming pile. The pick correspond to the weft yarn W1 or W6 or W11 composes the ground woven fabric section.

The pile formed in the pile forming section has snarls. The number of snarls is 3 to 6. Preferably, the number of snarls is 4 to 5. In the diagram, the number of snarls is 4.

The 2nd embodiment comprises the ground woven fabric section and snarls so that the same effect as the 1st embodiment can be obtained.

Incidentally, in the 2nd embodiment, the upper pile and the lower pile invert alternately. Therefore, the 2nd embodiment can be applied to a plain towel and the like, having no pattern.

The 3rd Embodiment

Figure 7A:
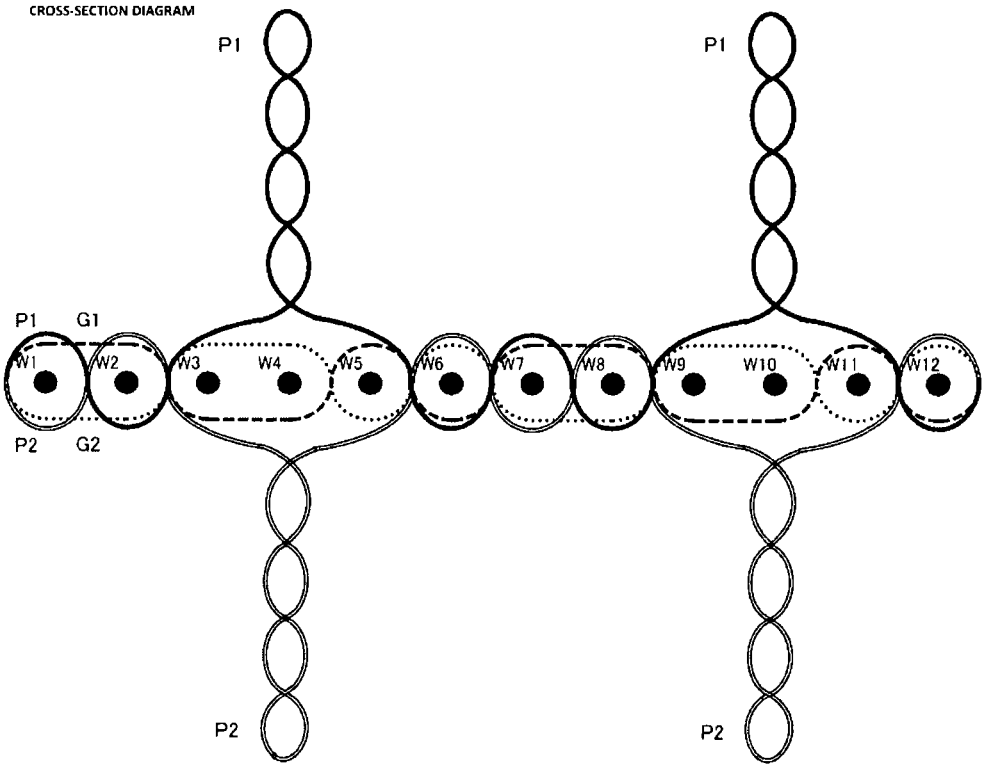
FIG. 7A is a cross-section diagram of the 3rd embodiment.
Figure 7B:
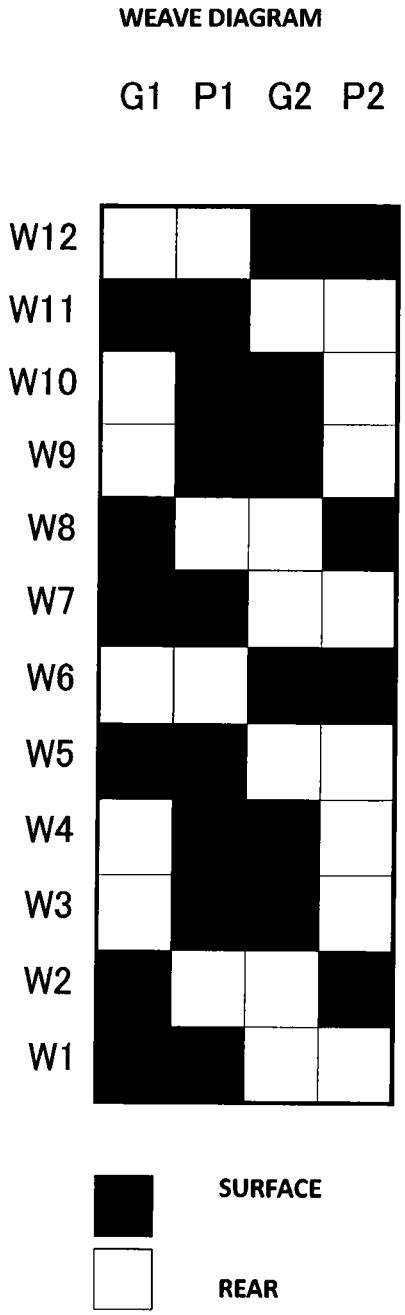
FIG. 7B is a weave diagram of the 3rd embodiment.
Figure 7C:
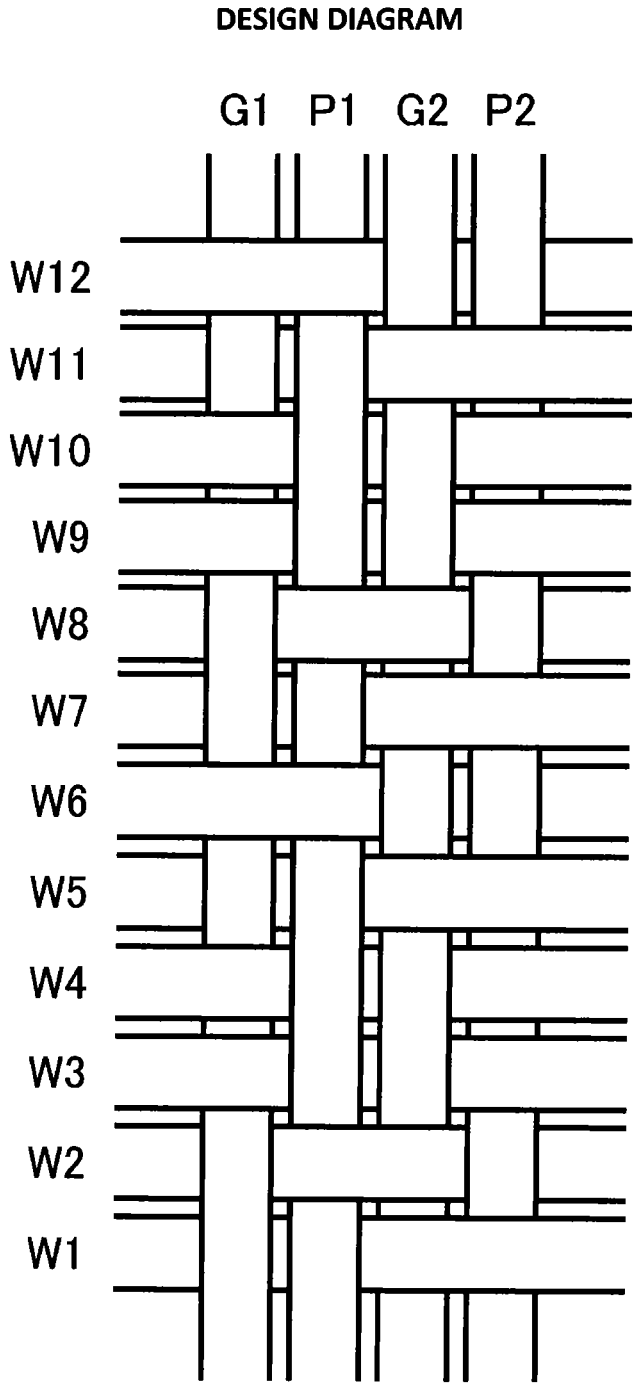
FIG. 7C is a design diagram of the 3rd embodiment.

FIG. 7 shows the towel product of the 3rd embodiment of the present invention. FIG. 7A is a cross-section diagram. FIG. 7B is a weave diagram. FIG. 7C is a design diagram. The warp density thereof is 27 to 34 ends/inch, and the weft density thereof is 45 to 60 ends/inch. The pile ratio is 3.8 to 7.0.

Preferably, the warp density thereof is 27 to 33 ends/inch, and the weft density thereof is 50 to 58 ends/inch. The pile ratio is 4.0 to 6.0.

More preferably, the warp density thereof is 28.5 to 32 ends/inch, and the weft density thereof is 53.5 to 56.5 ends/inch. The pile ratio is 4.5 to 5.5.

The number of pick is 6. That is, 1 repeat is configured with 6 picks and the configurations of 1 repeat are repeated.

The configuration of the 1 repeat (6 picks) has the pile forming section formed of 4 picks and the ground woven fabric section formed of 2 picks.

The pile yarn rises between the weft yarns W2 and W3, and returns between the weft yarns W5 and W6. The pile forming section is composed of the 4 picks correspond to the weft yarns W2-W5. Similarly, the 4 picks correspond to the weft yarns W8-W11 compose the pile forming section.

At the 2 picks correspond to the weft yarn W6-W7, pile yarn crosses weft yarn without forming pile. The 2 picks correspond to the weft yarns W6-W7 compose the ground woven fabric section.

The pile formed in the pile forming section has snarls. The number of snarls is 3 to 6. Preferably, the number of snarls is 4 to 5. In the diagram, the number of snarls is 4.

The 3rd embodiment comprises the ground woven fabric section and snarls so that the same effect as the 1st embodiment can be obtained.

The 4th Embodiment

Figure 8A:
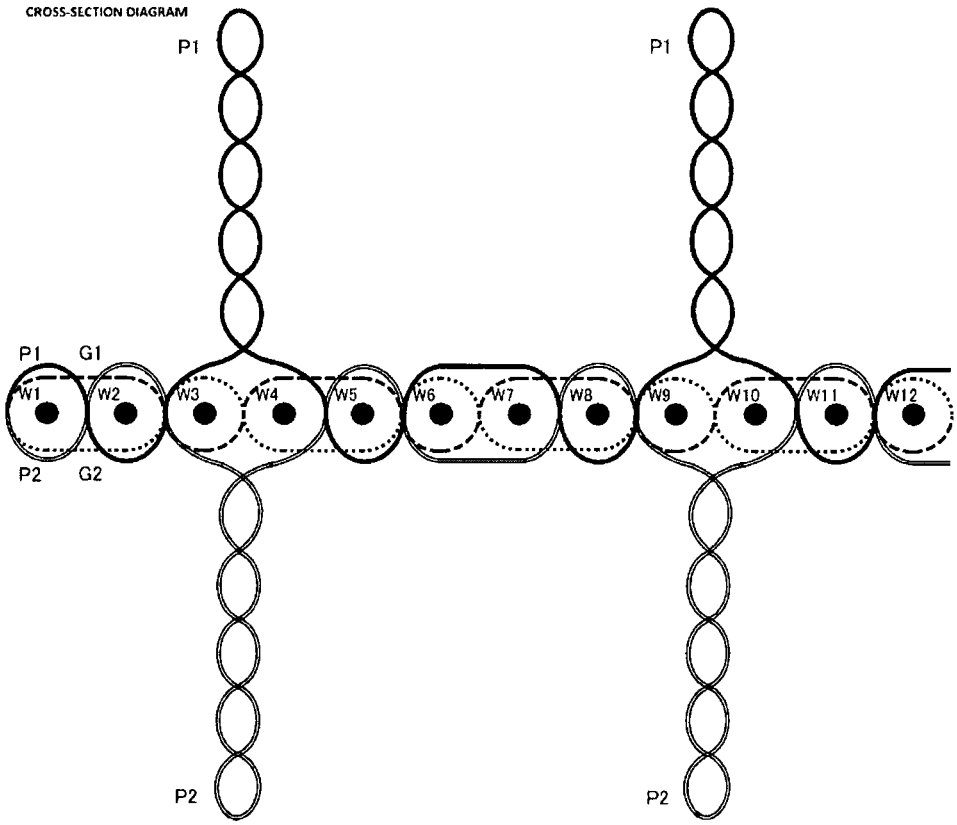
FIG. 8A is a cross-section diagram of the 4th embodiment.
Figure 8B:
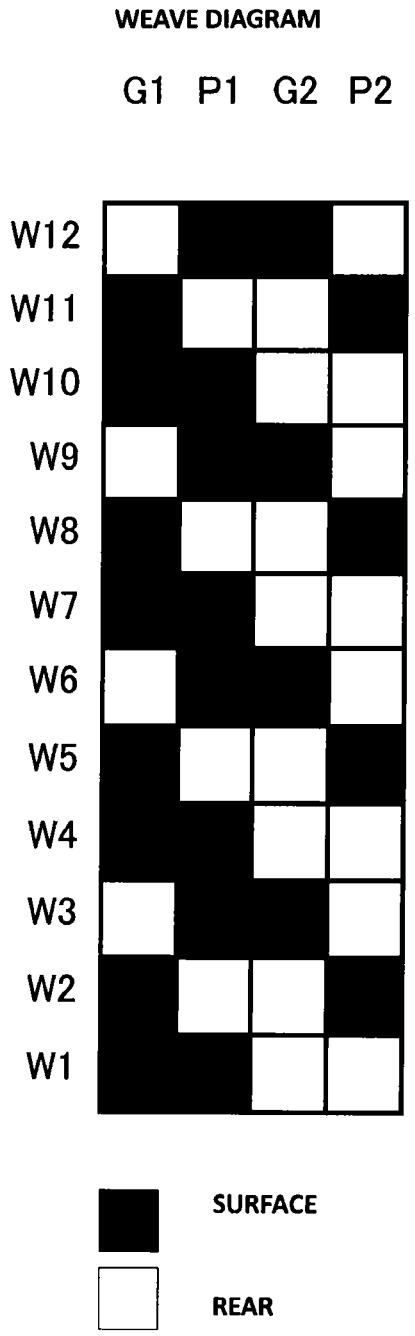
FIG. 8B is a weave diagram of the 4th embodiment.
Figure 8C:
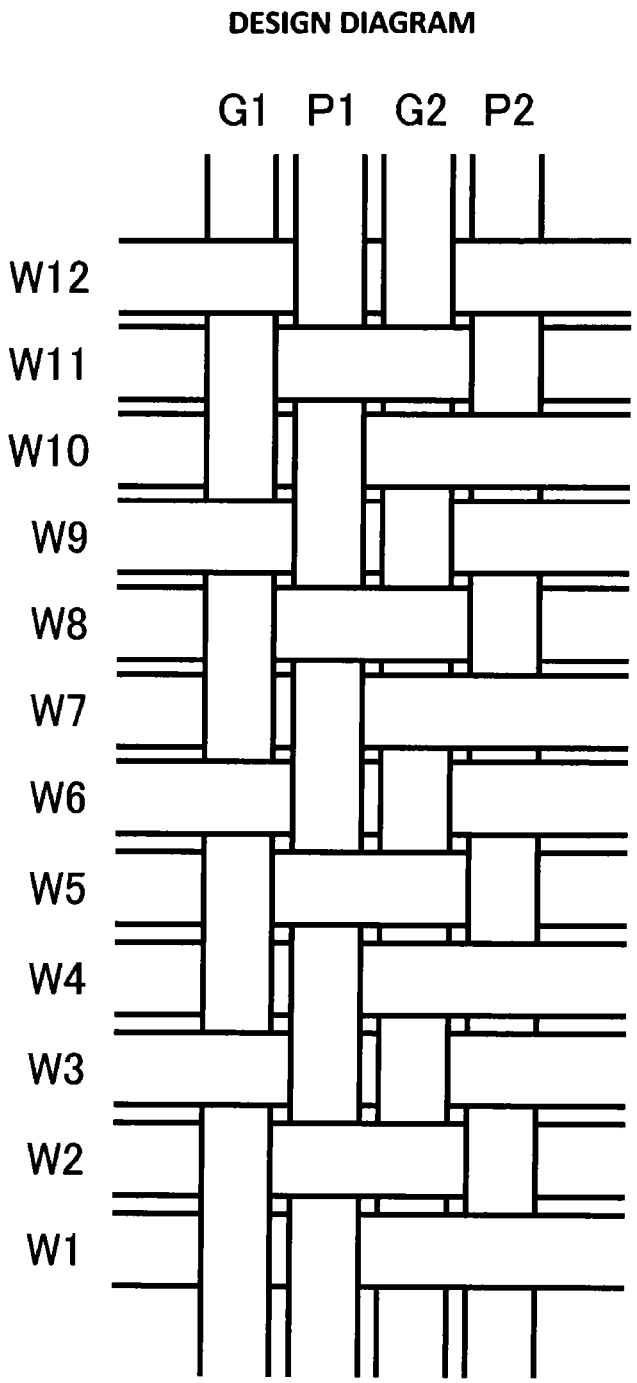
FIG. 8C is a design diagram of the 4th embodiment.

FIG. 8 shows the towel product of the 4th embodiment of the present invention. FIG. 8A is a cross-section diagram. FIG. 8B is a weave diagram. FIG. 8C is a design diagram. The warp density thereof is 27 to 34 ends/inch, and the weft density thereof is 45 to 60 ends/inch. The pile ratio is 3.8 to 7.0.

Preferably, the warp density thereof is 27 to 33 ends/inch, and the weft density thereof is 50 to 58 ends/inch. The pile ratio is 4.0 to 6.0.

More preferably, the warp density thereof is 28.5 to 32 ends/inch, and the weft density thereof is 53.5 to 56.5 ends/inch. The pile ratio is 4.5 to 5.5.

The number of pick is 6. That is, 1 repeat is configured with 6 picks and the configurations of 1 repeat are repeated.

The configuration of the 1 repeat (6 picks) has the pile forming section formed of 3 picks and the ground woven fabric section formed of 3 picks.

The pile yarn rises between the weft yarns W2 and W3, and returns between the weft yarns W4 and W5. The pile forming section is composed of the 3 picks correspond to the weft yarns W2-W4. Similarly, the 3 picks correspond to the weft yarns W8-W10 compose the pile forming section.

At the 3 picks correspond to the weft yarn W5-W7, pile yarn crosses weft yarn without forming pile. The 3 picks correspond to the weft yarns W5-W7 compose the ground woven fabric section.

The pile formed in the pile forming section has snarls. The number of snarls is 3 to 6. Preferably, the number of snarls is 4 to 5. In the diagram, the number of snarls is 5.

The 4th embodiment comprises the ground woven fabric section and snarls so that the same effect as the 1st embodiment can be obtained.

The 5th Embodiment

Figure 9A:
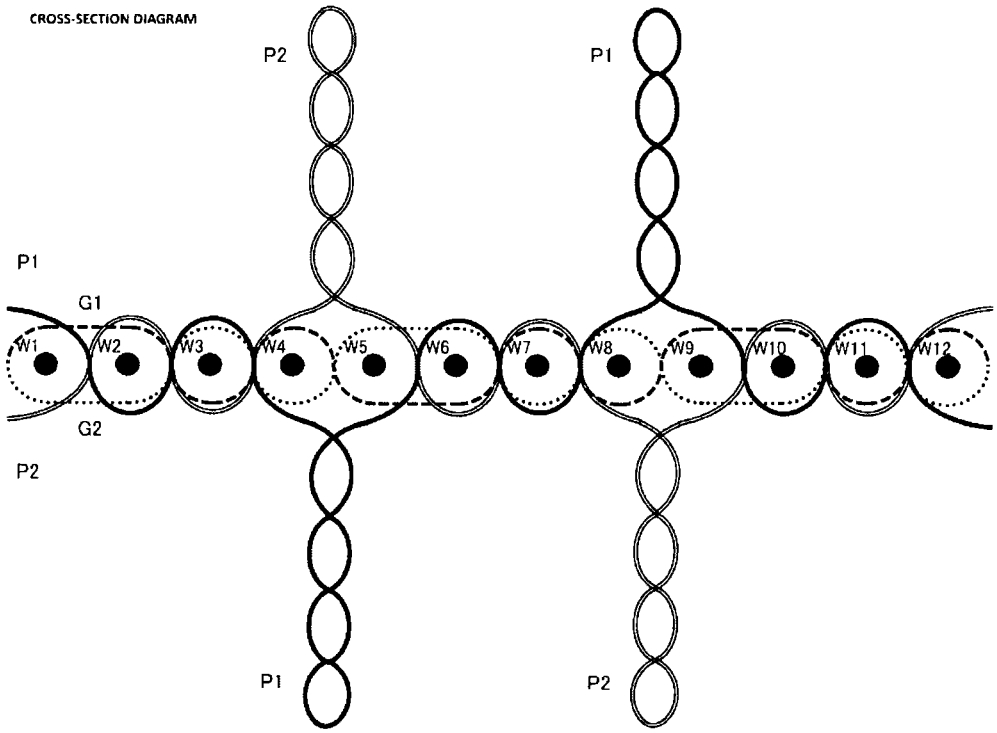
FIG. 9A is a cross-section diagram of the 5th embodiment.
Figure 9B:
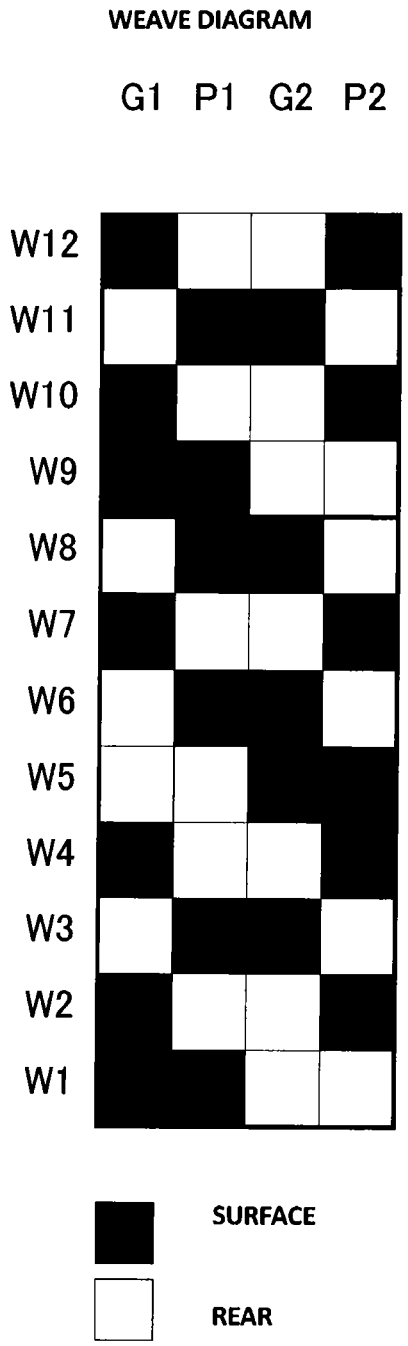
FIG. 9B is a weave diagram of the 5th embodiment.
Figure 9C:
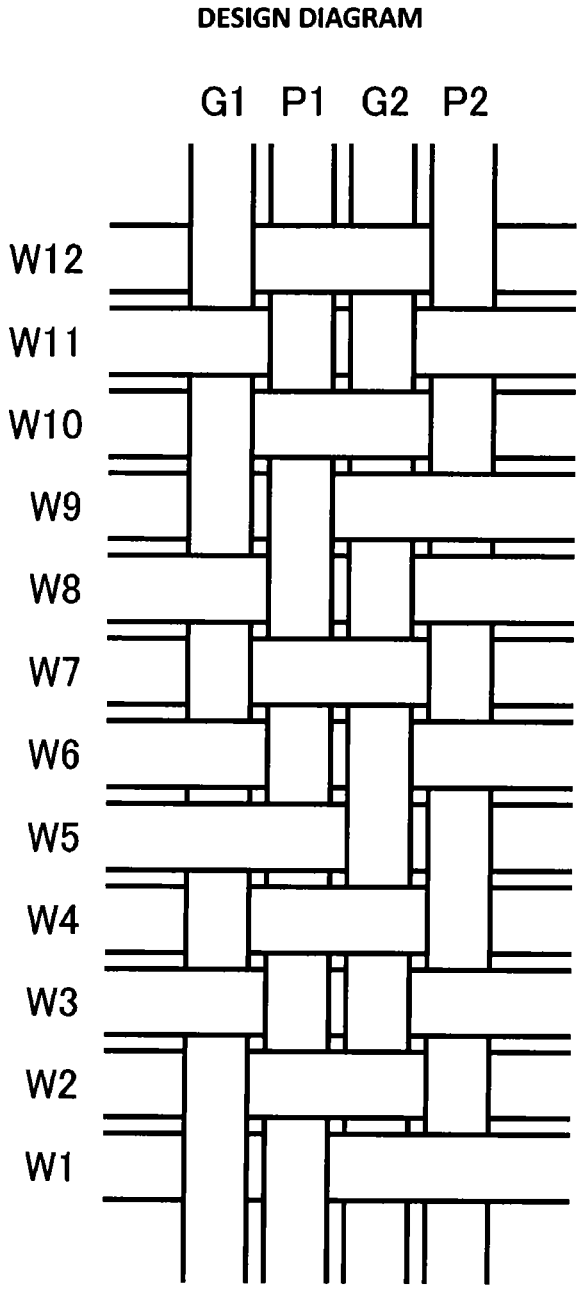
FIG. 9C is a design diagram of the 5th embodiment.

FIG. 9 shows the towel product of the 5th embodiment of the present invention. FIG. 9A is a cross-section diagram. FIG. 9B is a weave diagram. FIG. 9C is a design diagram. The warp density thereof is 27 to 34 ends/inch, and the weft density thereof is 45 to 60 ends/inch. The pile ratio is 3.8 to 7.0.

Preferably, the warp density thereof is 27 to 33 ends/inch, and the weft density thereof is 50 to 58 ends/inch. The pile ratio is 4.0 to 6.0.

More preferably, the warp density thereof is 28.5 to 32 ends/inch, and the weft density thereof is 53.5 to 56.5 ends/inch. The pile ratio is 4.5 to 5.5.

The number of pick is 4. That is, 1 repeat is configured with 4 picks and the configurations of 1 repeat are repeated.

The configuration of the 1 repeat (4 picks) has the pile forming section formed of 3 picks and the ground woven fabric section formed of 1 pick.

The pile yarn rises between the weft yarns W3 and W4, and returns between the weft yarns W5 and W6. In order to compare with conventional and general product, the pile forming section is defined as the 3 picks correspond to the weft yarns W3-W5, though the weft yarn W6 involves in formation of pile actually. Similarly, the 3 picks correspond to the weft yarns W7-W9 compose the pile forming section.

At the 1 pick correspond to the weft yarn W2 or W6 or W10, pile yarn crosses weft yarn without forming pile. The pick correspond to the weft yarn W2 or W6 or W10 composes the ground woven fabric section.

The pile formed in the pile forming section has snarls. The number of snarls is 3 to 6. Preferably, the number of snarls is 3 to 5. In the diagram, the number of snarls is 4.

Incidentally, in the 5th embodiment, the upper pile and the lower pile invert alternately. Therefore, the 5th embodiment can be applied to plain towel and the like, having no pattern.

Other Embodiment

The 2nd to 5th embodiments are illustrated above. But the present invention is not limited to the 2nd to 5th embodiments. However, the following points regarding the number of picks and the number of snarls should be remarked.

In the case the number of picks is less than 4, the towel is similar to conventional and general product so that it is unable to implement drying property and lightness property. On the other hand, in the case the number of picks is more than 6, the towel is unable to implement water absorbency property. In other words, extremely longer pile is required so as to compensate a loss of water absorbency property. That is hardly realized.

In the case the number of snarls is less than 3, pile retention property cannot be expected sufficiently. On the other hand, extremely longer pile is limited, so that the number of snarls is limited not to be more than 6.

The invention claimed is:

1. A towel product formed from a plurality of warp yarns, a plurality of weft yarns, and a plurality of pile yarns, wherein:

a warp density of said towel product is 27 ends/inch to 34 ends/inch, and a weft density of said towel cloth is 45 ends/inch to 60 ends/inch;

a pile ratio is 3.8 to 7.0;

a number of picks regarding a configuration of 1 repeat is 4 to 6, where the configuration of 1 repeat is repeated;

said pile yarns have a pile forming section and a ground woven fabric section; and said pile yarns formed in said pile forming section have 3 snarls to 6 snarls in said pile forming section of said pile yarns, wherein a pile retention property is 4000 mN and more, and wherein the snarls are uniform.

2. The towel product according to claim 1, wherein:

said number of picks is 5 per repeat, said pile forming section is formed of 3 picks per repeat, and said ground woven fabric section is formed of 2 picks per repeat.

3. The towel product according to claim 1, wherein:

said number of picks is 5 per repeat, said pile forming section is formed of 4 picks per repeat, and said ground woven fabric section is formed of 1 pick per repeat.

4. The towel product according to claim 1, wherein:

said number of picks is 6 per repeat, said pile forming section is formed of 4 picks per repeat, and said ground woven fabric section is formed of 2 picks per repeat.

5. The towel product according to claim 1, wherein:

said number of picks is 6 per repeat, said pile forming section is formed of 3 picks per repeat, and said ground woven fabric section is formed of 3 picks per repeat.

6. The towel product according to claim 1, wherein:

said number of picks is 4 per repeat, said pile forming section is formed of 3 picks per repeat, and said ground woven fabric section is formed of 1 pick per repeat.

7. The towel product according to claim 1, wherein:

said pile yarns are formed of a single yarn.

8. The towel product according to claim 1, wherein:

said pile yarns are formed of a double yarn.

* * * * *